United States Patent [19]

Grimes

[11] 4,125,920

[45] Nov. 21, 1978

[54] FASTENING MECHANISM

[76] Inventor: Larry R. Grimes, 3476 E. Ashlan, Apt. 178, Fresno, Calif. 93726

[21] Appl. No.: 784,333

[22] Filed: Apr. 4, 1977

[51] Int. Cl.[2] ..... A44B 11/00; A44C 5/00

[52] U.S. Cl. ..... 24/201 R; 24/223; 70/456 R; 224/28 E

[58] Field of Search ..... 24/222 R, 201 R, 190, 24/73 J, 223; 70/456 R; 224/28 E

[56] References Cited

U.S. PATENT DOCUMENTS

| | | | |
|---|---|---|---|
| 2,105,909 | 1/1938 | Dick | 24/223 |
| 2,413,337 | 12/1946 | Segal | 70/456 R |
| 2,503,570 | 4/1950 | Vogel | 24/201 R |
| 3,000,658 | 9/1961 | Sprouse | 24/223 |

FOREIGN PATENT DOCUMENTS

| | | | |
|---|---|---|---|
| 113,315 | 6/1940 | Australia | 24/222 |
| 23,226 of | 1894 | United Kingdom | 24/201 R |

*Primary Examiner*—Kenneth J. Dorner
*Attorney, Agent, or Firm*—Huebner & Worrel

[57] ABSTRACT

A fastening mechanism for the interconnection of the opposite ends of a watch band or the like, the mechanism having a key for auxiliary use with a handle portion borne by one of the opposite ends of the watch band, affording shoulders convergent in the direction of the band, and an opposite shaft portion; a key holder secured on the other of the ends of the watch band dimensioned to form a recess to receive the handle portion of the key and to engage the shoulders thereof to prevent relative movement between the key and holder in the plane of the handle portion; and a closure received on the holder for selective engagement with the shaft portion of the key to prevent movement of the key from the plane of the handle portion.

2 Claims, 4 Drawing Figures

FASTENING MECHANISM

BACKGROUND OF THE INVENTION

1. Field of the Invention

The present invention relates to a fastening mechanism and more particularly to such a fastening mechanism which possesses a dependable, compact, and simplified structure for interconnecting the ends of objects such as watch bands and the like and which employs a key auxiliary use as an operative component of the fastening mechanism.

2. Description Of The Prior Art

A chronic difficulty inherent in daily life resides in the fact that keys must be employed to gain access to homes, to operate automobiles, to open business offices and a myriad of other locked enclosures and key operated devices. Frequently such keys are temporarily lost or locked within confines to which access is not possible without having an auxiliary key.

Prior art remedies have included the use of hidden containers for auxiliary keys which are mounted in hidden positions on the exterior of houses, automobiles and the like for use in such circumstances. The difficulty with such devices is that all too frequently the auxiliary keys, once used, are not replaced for reuse when necessary. Furthermore, the availability of such keys to intruders constitutes an ever present hazard. Other attempts have been made to provide hidden compartments in wearing apparel, jewelry and the like for the retention of auxiliary keys so that they are carried on the person for subsequent use. However, such prior art devices are bulky, must often be moved from one article of wearing apparel or jewelry to another if they are to be maintained on the person of the user and frequently are not replaced once they have been used.

Therefore, it has long been known that it would be desirable to have a means for maintaining an auxiliary key on the person of the user in a manner which insures that the key is always available for use when necessary and which does not interfere with the daily routine of the user.

SUMMARY OF THE INVENTION

Therefore it is an object of the present invention to provide an improved fastening mechanism.

Another object is to provide such a fastening mechanism which incorporates a key for auxiliary use.

Another object is to provide such a fastening mechanism which employs a key as an operative component of the fastening mechanism.

Another object is to provide such a fastening mechanism which is compact so as not to interfere with normal use of the object on which it is employed.

Another object is to provide such a fastening mechanism which is readily connected and disconnected.

Another object is to provide such a fastening mechanism which is not subject to inadvertent release during normal use.

Another object is to provide such a fastening mechanism which is capable of employing virtually any type of key.

Another object is to provide such a fastening mechanism which conceals the key during use.

Other objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figure 1:
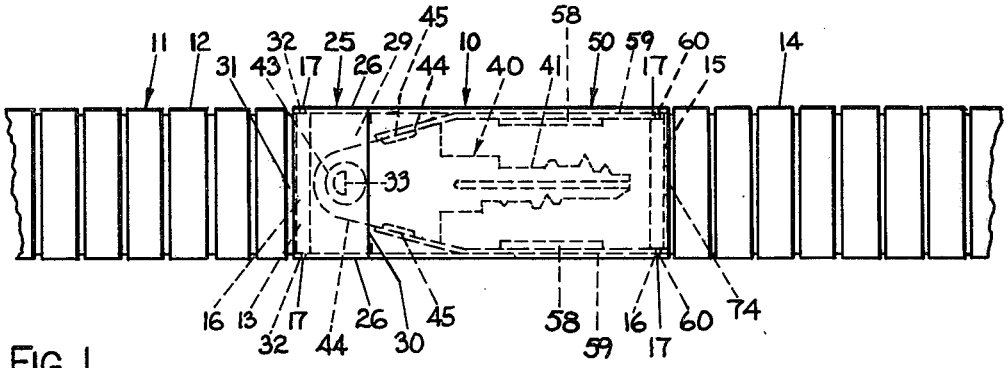
FIG. 1 is a somewhat enlarged top plan view of the fastening mechanism of the present invention shown in a typical operative environment interconnecting the free ends of a watch band.

Referring more particulary to the drawing, the fastening mechanism of the present invention is indicated at 10 in FIG. 1. For illustrative convenience and as shown in FIG. 1, the fastening mechanism is disclosed in a typical operative environment as an operable part of a watch band 11. As will become more clearly apparent, the fastening mechanism can be employed to interconnect the ends of a wide variety of types of objects. The watch band 11 is illustrative of a particularly advantageous utilization.

The watch band 11 is composed of a first band 12, having a connection sleeve 13 at one end thereof extending transversely of the first band, and a second band 14, having a connection sleeve 15 at an end thereof extending transversely of the second band. In the conventional fashion, each connection sleeve 13 and 15 is adapted to receive a standard connection pin assembly 16. Each assembly has oppositely extending pins 17 which can be pressed inwardly within the assembly against spring tension for assembly as will hereinafter be described. The remote ends, not shown, of the bands are, of course, adapted to be connected to a watch in any desired manner.

The fastening mechanism 10 of the present invention has a key retainer 25 composed of substantially parallel opposite side walls 26, a top wall 27 and a bottom wall 28. The walls 26, 27 and 28 are integral and form a box like construction defining a passage 29 extending longitudinally therethrough and outwardly of the retainer through a front opening 30 at one end and a rear opening 31 at the other end thereof. The side walls 26 having individual pin holes 32 extending therethrough and aligned transversely of the retainer in predetermined positions adjacent to the rear opening 31. The bottom wall 28 has a portion which is pressed inwardly of the retainer to form a resilient catch 33 which extends obliquely from the front opening 30 of the retainer.

The key retainer 25 is mounted on the first band 12 of the watch band 11 by the insertion of the connection pin assembly 16 through the connection sleeve 13, the depression of the pins 17 to permit insertion of the connection sleeve and pin assembly through the rear opening 31 of the retainer and the individual insertion of the pins 17 through their respective pin holes 32. The key retainer is thus mounted on the first band 12, as shown in the drawing.

The fastening mechanism 10 has an auxiliary key 40 which forms an operable member of the fastening mechanism. The key has a substantially straight shaft portion 41 and an opposite handle or head portion 42. An opening 43 is provided in the head portion. The auxiliary key can, in accordance with the present invention, be a standard key which has been modified for operation in the fastening mechanism. Preferably, however, the key is manufactured with the other portions of the fastening mechanism. In this latter case the shaft portion 41 is manufactured in the form of a blank and is machined to form a key for a specific lock at the direction of the purchaser. In either event, the head portion 42 is preferably bent out of the plane of the shaft portion, to define an arc, as shown in the drawing. The head portion can also simply be bent relative to the shaft portion to form a substantially flat plane of its own. The head portion of the key has tapered shoulders or edges 44 which converge in a direction away from the shaft portion 41 of the key, as best shown in FIG. 1. The tapered edges have indentations 45 therein in predetermined positions aligned transversely of the head portion.

Figure 2:
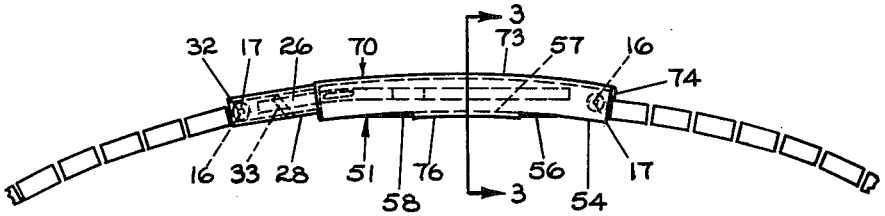
FIG. 2 is a side elevation of the fastening mechanism of FIG. 1.

The fastening mechanism 10 has a clasp or lock assembly 50 which includes a housing or key holder 51 forming an operable member of the fastening mechanism. The key holder has a rear portion 52 and an opposite front portion 53 and is of a substantially longitudinally arcuate configuration, as best shown in FIG. 2. The key holder has an arcuate bottom wall 54 having an interior surface 55 and an opposite exterior surface 56. The bottom wall is arched downwardly along its central portion to define a central receptacle or recess 57 extending longitudinally of the bottom wall for receipt of the shaft portion 41 of the key 40 therewithin, as will hereinafter be described. The portions of the exterior surface of the bottom wall on opposite sides of the recess serve as a pair of arcuate tracks 58 extending along the lateral margins of the bottom wall. A pair of upstanding side walls 59 are borne by the bottom wall in right-angular relation thereto extending between the front and rear portions of the key holder. A pair of pin holes 60 are individually provided in the side walls aligned transversely of the key holder in closely spaced relation to the rear portion 52 of the key holder. The side walls have convergent portions 61 which approach each other at the front portion 53 of the key holder to define a recess or receptacle 62 dimensioned to receive the head portion 42 of the auxiliary key 40. The upper edges of the convergent portions are slightly lower than the upper edges of the remainder of the side walls, as can best be seen in FIG. 4. The convergent portions 61 of the side walls 59 have snap fittings or projections 63 which extend inwardly of the receptacle and are positioned for receipt in the indentations 45 of the head portion of the auxiliary key.

The key holder 51 is mounted on the second band 14 of the watch band 11 by the insertion of a connection pin assembly 16 through the connection sleeve 15 of the second band. The pins 17 of the assembly 16 are pressed toward each other and the assembly and sleeve of the second band are inserted between the side walls 59 of the bottom wall at the rear portion 52 thereof. The pins 17 are released for individual receipt in the pin holes 60 thereby mounting the key holder on the second band, as shown in the drawing.

Figure 3:
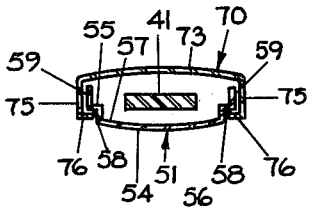
FIG. 3 is a somewhat enlarged transverse section taken on line 3—3 in FIG. 2.

An arcuate closure 70 composes an operable part of the lock assembly 50 and is slidably received on the key holder 51, as will hereinafter be described. The closure has a rear portion 71 and an opposite front portion 72. The closure has an arcuate top wall 73 having a stop 74 extending downwardly therefrom at the rear portion 71 of the closure. The closure has a pair of downwardly extending side walls 75 which have inwardly extending lips 76. A pair of stops 77 individually interconnect each side wall on the top wall of the closure. The closure is snap-fitted over the key holder so that the lips 76 individually engage the arcuate tracks 58 and the side walls 75 extend about the side walls 59 of the key holder, as best shown in FIG. 3. Thus, the closure is received for slidable movement from the position shown in FIG. 4 to the position shown in FIGS. 1 and 2. Stop 74 engages the connection sleeve 15 of the second band 14 when the closure is in the fully closed position shown in FIGS. 1 and 2. The stops 77 engage the edges of the side walls when the closure is in the fully open position shown in FIG. 4.

OPERATION

The operation of the described embodiment of the subject ivention is believed to be clearly apparent and is briefly summarized at this point. The watch band 11 is mounted with the fastening mechanism 10, as previously described, so that the auxiliary key 40 is captured in the key retainer 45 on the first band 12 and the lock assembly 50 is connected to the second band 14.

Figure 4:
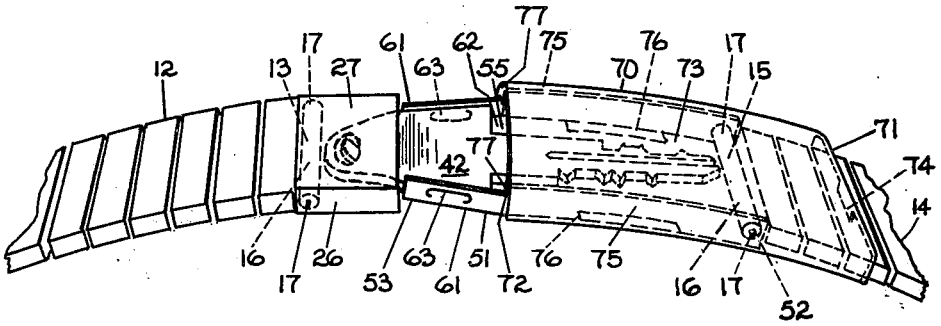
FIG. 4 is a perspective view of the fastening mechanism showing the cover plate in a retracted position to expose the shaft portion of the key.

To operate the fastening mechanism for interconnection of the first and second bands, the arcuate closure 70 is first slidably retracted to the position shown in FIG. 4 so as to expose the receptacle 62 of the key holder 51. Subsequently, the shaft portion 41 of the auxiliary key 40 is simply inserted under the closure 70 within the key holder 51 with the head portion 42 of the key above the receptacle 62 of the key holder. The head portion is then simply snapped downwardly into the receptacle so that the projections 63 of the key holder are snap-fitted in the indentations 45 of the tapered edges 44 of the head portion. Thus, as shown best in FIG. 4, the tapered edges 44 engage the convergent portions 61 of the key holder. Subsequently, the arcuate closure 70 is simply slidably motiviated to the closed position shown in FIGS. 1 and 2 in which the closure extends over and conceals the auxiliary key within the lock assembly 50.

To operate the fastening mechanism 10 to disconnect the first and second bands 12 and 14 respectively, the arcuate closure 70 is slidably motiviated to the retracted position shown in FIG. 4. Subsequently, the head portion 42 of the key is forced upwardly out of the receptacle 62 of the key holder so as to release the projection 63 from the indentations 45 and disengage the tapered edges 44 from the convergent portions 61. Th shaft portion 41 of the key is then simply withdrawn from the lock assembly 50. Thereafter, if necessary, the key can be used in the normal manner to operate the lock for which it is designed.

It will be seen that the fastening mechanism 10 securely retains the key in position through the interoperation of the projections 63 and indentations 45, the tapered edges 44 and convergent portions 61, and the capturing engagement of the closure 70 and the key holder 51. The fastening mechanism thus has several fastening interconnections to insure that the mechanism does not inadvertently release. It will be seen that by affording a structure preventing slidable movement between the key and key holder at the front portion of the key holder and engagement of the closure with the remote end of the shaft portion of the key to preclude pivoting of the key from the key holder, the fastening mechanism affords a positive interconnection. It will also be understood that the curvature of the fastening mechanism can be of an arc suitable for comfortable use limited only by the need to maintain the shaft portion of the key in a straight condition.

Therefore, the fastening mechanism of the present invention affords a practical, compact, dependable and readily available device for fastening a watch band, bracelet or the like while incorporating an auxiliary key for use in an emergency situation.

Although the invention has been herein shown and described in what is conceived to be the most practical and preferred embodiment, it is recognized that departures may be made therefrom within the scope of the invention, which is not to be limited to the illustrative details disclosed.

Having described my invention what I claim as new and desire to secure by Letters Patent is:

1. A fastening mechanism for a watch band or the like having opposite ends, the mechanism comprising a key having a handle portion attached to one of the opposite ends, being curved and having edges convergent in the direction of the watch band and an opposite substantially flat shaft portion; a housing attached to the other of said opposite ends dimensioned to receive the shaft portion of the key and having a portion remote from said other of said opposite ends curved to conform to the curve of the handle portion of the key with upstanding walls bounding said curved portion of the housing and convergent for individual engagement with said edges of the key; and a closure slidably mounted on the housing releasably to capture the key within the housing.

2. A fastening mechanism for a watch band or the like having opposite ends, the mechanism comprising a key having a handle portion, with predetermined edges, attached to one of the opposite ends and an opposite shaft portion; a housing attached to the other of said opposite ends dimensioned to receive the shaft portion of the key and having a recessed portion remote from said other of said opposite ends bounded by upstanding and unmerging walls disposed to engage said predetermined edges of the handle portion of the key to prevent movement of the opposite ends from each other along a first path while permitting said handle portion to be removed from said recess along a second path; and a closure having a top wall and being mounted on the housing for movement between a position in which said top wall overlays the recessed portion of the housing and said upstanding walls to capture the handle portion of the key within the housing and a position spaced therefrom freeing the handle portion for movement along said second path from the housing.

* * * * *

UNITED STATES PATENT AND TRADEMARK OFFICE

CERTIFICATE OF CORRECTION

PATENT NO. : 4,125,920

DATED : November 21, 1978

INVENTOR(S) : Larry R. Grimes

It is certified that error appears in the above-identified patent and that said Letters Patent are hereby corrected as shown below:

Column 1, line 11, between "key" and "auxiliary" insert ---for---.

Column 4, line 48, change "Th" to --The--.

Column 6, line 13, change "unmerging" to --converging--.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*